United States Patent [19]

Hirakouchi et al.

[11] Patent Number: 4,715,991

[45] Date of Patent: Dec. 29, 1987

[54] AQUEOUS HIGH CONCENTRATION SURFACTANT SLURRY CONTAINING AN OLEFIN SULFONATE

[75] Inventors: Yoshie Hirakouchi; Osamu Toisawa, both of Chiba; Masatoshi Takahashi, Fujisawa, all of Japan

[73] Assignee: Lion Corporation, Tokyo, Japan

[21] Appl. No.: 848,051

[22] Filed: Apr. 4, 1986

[30] Foreign Application Priority Data

Apr. 26, 1985 [JP] Japan ..... 60-90471

[51] Int. Cl.[4] ..... C11D 1/14; B01F 17/02

[52] U.S. Cl. ..... 252/555; 252/353; 252/536; 252/DIG. 14

[58] Field of Search ..... 252/536, 555, 353, DIG. 14

[56] References Cited

U.S. PATENT DOCUMENTS

| | | | |
|---|---|---|---|
| 3,755,203 | 8/1973 | Bentley et al. | 252/536 |
| 3,852,221 | 12/1974 | Bentley | 252/548 |
| 3,954,679 | 5/1976 | Wixon | 252/555 |
| 3,970,596 | 7/1976 | Klisch et al. | 252/546 |
| 4,139,498 | 2/1979 | Kawakami et al. | 252/555 |
| 4,239,662 | 12/1980 | Okumura et al. | 252/555 |
| 4,299,740 | 11/1981 | Messenger et al. | 252/545 |
| 4,507,223 | 3/1985 | Tano et al. | 252/353 |

FOREIGN PATENT DOCUMENTS

| | | |
|---|---|---|
| 56108 | 5/1977 | Japan . |
| 52-078828 | 7/1977 | Japan . |
| 58-157758 | 9/1983 | Japan . |

*Primary Examiner*—Prince E. Willis

*Attorney, Agent, or Firm*—Armstrong, Nikaido, Marmelstein & Kubovcik

[57] ABSTRACT

An aqueous high concentration surfactant slurry comprising:

(A) 50% to 75% by weight of $C_{12}$–$C_{20}$ olefin sulfonates substantially composed of 8 to 60 parts by weight of at least one vinylidene type olefin sulfonate and 92 to 40 parts by weight of at least one linear olefin sulfonate;

(B) 1% to 5% by weight of sodium chloride, potassium chloride, or a mixture thereof;

(C) 0.3% to 5% by weight of at least one nonionic substance selected from the group consisting of (C-1) polyoxypropylene glycols having an average molecular weight of 170 to 300, (C-2) ethylene oxide addition products of secondary higher alcohols having a $C_7$–$C_{18}$ alkyl group and an average addition mole number of ethylene oxide of 7 to 12, and (C-3) addition products of ethylene oxide (i.e., an average addition mole number of 3 to 10) and propylene oxide (i.e., an average addition mole number of 1 to 9) of secondary higher alcohols having a $C_7$–$C_{18}$ alkyl group provided that the total addition mole number of the ethylene oxide and the propylene oxide is 6 to 12.

This aqueous high concentration surfactant slurry has a low viscosity at room temperature. Therefore, the slurry can be efficiently stored and the costs necessary for packaging, transporting, and storing the slurry can be advantageously decreased.

2 Claims, No Drawings

AQUEOUS HIGH CONCENTRATION SURFACTANT SLURRY CONTAINING AN OLEFIN SULFONATE

BACKGROUND OF THE INVENTION

1. Field of the Invention

The present invention relates to an aqueous high concentration surfactant slurry containing an olefin sulfonate. More specifically, it relates to an aqueous high concentration olefin sulfonate surfactant slurry having a decreased viscosity, which is easily handled and pumped at room temperature.

2. Description of the Related Art

Olefin sulfonates having an alkyl group with 12 to 20 carbon atoms suitable for use as a raw material for home and industrial detergents are generally used in the form of a slurry containing about 40% or less of the olefin sulfonates, to obtain an easy to handle slurry having a uniform quality. However, a higher concentration slurry has been desired from the standpoints of the decrease in the temperature and the packaging costs and also of improvements in the efficiency of storage.

When the olefin sulfonate concentration in an aqueous olefin sulfonate slurry is approximately 40% by weight or more, the viscosity of the olefin sulfonate slurry is rapidly increased to form a gellation and thus lose fluidity. When the olefin sulfonate concentration is further increased to, for example, 60% to 70% by weight, the viscosity is gradually decreased between these ranges, but the fludity of the slurry is still very poor. Therefore, an aqueous high concentration olefin sulfonate slurry having a low viscosity is strongly required in the art from the standpoints of the handling and pumping transportation thereof. Typically, an aqueous olefin sulfonate slurry having a viscosity of 150 poise or less at room temperature (i.e., 25° C.) is commercially important in view of the thermal insulation or maintenance of temperature and the necessary costs during the storage thereof.

Various attempts have been heretofore made to decrease the viscosity of an aqueous high concentration slurry of olefin sulfonates. For example, the addition of sodium formate (e.g., U.S. Pat. No. 4,003,875) and the addition of polyethylene glycol or polyoxyethylene alkyl ether in combination with aromatic carboxylate (i.e., salt) (e.g., Japanese Unexamined patent publication (Kokai) No. 58-157758) have been proposed. However, these additives can prevent the gellation of the high concentration slurry only at an elevated temperature. These additives cannot decrease the viscosity of the aqueous high concentration slurry of olefin sulfonates at room temperature to an extent such as commercially required, since the slurry is solidified at room temperature or because the desired fluidity cannot be obtained at room temperature.

In addition, Japanese Unexamined Patent Publication (Kokai) No. 52-78828 proposes the production of an aqueous high concentration slurry of olefin sulfonates by adding an excess amount of an alkaline substance and an alkylene oxide. However, the high concentration slurry thus obtained has a disadvantage in that special precautions must be taken during handling due to the high pH thereof and that the slurry must be neutralized when used. As a result, a large amount of salts are produced as by-products. Especially when the aqueous high concentration slurry is used as a starting material for liquid detergents, shampoos, or the like, the usable amount of the slurry is inherently limited to avoid worsening the liquid property of the product. Thus, according to existing techniques, there are large limitations in the utility thereof and, moreover, the desired decrease in the viscosity of the aqueous high concentration slurry of olefin sulfonates at room temperature has not been accomplished as yet.

SUMMARY OF THE INVENTION

Accordingly, the object of the present invention is to decrease the viscosity of an aqueous high concentration slurry of olefin sulfonates (i.e., an aqueous slurry containing 50% by weight or more of olefin sulfonates) at room temperature.

Other objects and advantages of the present invention will be apparent from the following description.

In accordance with the present invention, there is provided an aqueous high concentration surfactant slurry comprising:

(A) 50% to 75% by weight of $C_{12}$–$C_{20}$ olefin sulfonates substantially composed of 8 to 60 parts by weight of at least one vinylidene type olefin sulfonate and 92 to 40 parts by weight of at least one linear olefin sulfonate;

(B) 1% to 5% by weight of sodium chloride, potassium chloride, or a mixture thereof;

(C) 0.3% to 5% by weight of at least one nonionic substance selected from the group consisting of (C-1) polyoxypropylene glycols having an average molecular weight of 170 to 300, (C-2) ethylene oxide addition products of secondary higher alcohols having a $C_7$–$C_{18}$ alkyl group and an average addition mole number of ethylene oxide of 7 to 12, and (C-3) addition products of ethylene oxide (i.e., an average addition mole number of 3 to 10) and propylene oxide (i.e., an average addition mole number of 1 to 9) of secondary higher alcohols having a $C_7$–$C_{18}$ alkyl group, provided that the total addition mole number of the ethylene oxide and the propylene oxide is 6 to 12.

DESCRIPTION OF THE PREFERRED EMBODIMENTS

The olefin sulfonates usable as component (A) in the aqueous slurry according to the present invention contain 8 to 60 parts by weight, preferably 10 to 60 parts by weight, of at least one $C_{12}$–$C_{20}$ vinylidene type olefin sulfonate, and 92 to 40 parts by weight, preferably 90 to 40 parts by weight, of at least one $C_{12}$–$C_{20}$ linear olefin sulfonate. The use of the vinylidene type olefin sulfonate of less than 8 parts by weight (i.e., the amount of the linear olefin sulfonates is more than 92 parts by weight) cannot provide the desired decrease in the viscosity (e.g., the commercially required viscosity of less than 150 poise at room temperature), even when the components (B) and (C) are used together.

The olefins to be sulfonized are represented as follows:

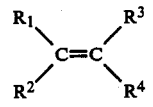

(I)

That is, in the case of the vinylidene olefins, $R^1$ and $R^2$ are an independent alkyl group and $R^3$ and $R^4$ are hydrogen in the general formula (I), and in the case of the linear olefins, $R^1$ and $R^4$ are an independent alkyl group and $R^2$ and $R^3$ are hydrogen in the general formula (I).

The sulfonation can be carried out in any conventional manner. For example, the starting olefin mixtures are sulfonated by, for example, $SO_3$ gas, using any conventional method (e.g., a batchwise method or thin-film type continuous method). The sulfonated products are then neutralized and hydrolyzed with an alkaline agent in any conventional manner. Thus, the desired olefin sulfonate mixture can be obtained. The resultant products usually contain the alkene sulfonates and hydroxyalkane sulfonates. As mentioned above, the total carbon number of the olefin sulfonates should be 12 to 20, preferably 12 to 18.

The olefin sulfonates usable as the component (A) according to the present invention are preferably water-soluble salts such as sodium salts and potassium salts.

The olefin sulfonates are included in the high concentration slurry in an amount of 50 to 75% by weight, preferably 60 to 75% by weight.

The sodium chloride and/or the potassium chloride usable as the component (B) in the present invention act synergestically, together with the component (C), to decrease the resultant high concentration slurry at room temperature. The sodium chloride and/or potassium chloride are included in the aqueous high concentration slurry of the olefin sulfonates in an amount of 1% to 5% by weight, preferably 1.5% to 5% by weight. The use of too small an amount of the component (B) does not result in the desired synergestic effects, with the component (C), to decrease the viscosity of the slurry at room temperature. Contrary to this, the use of too large an amount of the component (B) causes an unpreferable separation of the resultant slurry or the deposition of sodium chloride or potassium chloride with the elapse of time, whereby the composition of the slurry becomes nonuniform.

The nonionic substances usable as the component (C) are selected from the following components (C-1), (C-2), and (C-3). These components can be used alone or in any mixture thereof.

Component (C-1): Polyoxypropylene glycols having an average molecular weight of 170 to 300;

Component (C-2): Ethylene oxide (i.e., "EO") addition products of $C_7$–$C_{18}$ secondary higher alcohols having an EO addition mole number of 7 to 12, preferably 8 to 11;

Component (C-3): Addition products of ethylene oxide (i.e., "EO") and propylene oxide (i.e., "P") of secondary higher alcohols having an average EO addition mole number (i.e., $EO_p$) of 3 to 10, preferably 3 to 9, an average PO addition mole number (i.e., $PO_p$-) of 1 to 9, preferably 1 to 8, and a $C_7$–$C_{18}$ alkyl group, preferably $C_8$ to $C_{16}$ alkyl group, provided that the total number of $EO_p$- and $PO_p$- is 6 to 12, preferably 6 to 11.

Of these nonionic substances, the use of the ethylene oxide addition products of the secondary alcohols is preferable since the addition amount of non-active components to the slurry can be minimized when the slurry is used for the preparation of detergents.

The nonionic substances are used, as the component (C), in the aqueous slurry according to the present invention in an amount of 0.3% to 5% by weight, preferably 1% to 5% by weight. When the amount of the component (C) is not within this range, the desired synergistic effect, with the component (B), (i.e., NaCl and/or KCl) cannot be obtained. Also, the desired synergistic effect cannot be obtained when the average molecular weight of the component (C-1) is outside the above-specified range, when primary alcohols are used in lieu of the secondary alcohols in the components (C-2) and (C-3), or when the $EO_p$- or $PO_p$- of the component (C-2) or (C-3) is outside the above-specified range.

The above-mentioned components (A), (B), and (C) are formulated, in any conventional manner, with 15% to 48.7% by weight, preferably 15% to 37.5% by weight of water to form the desired aqueous high concentration slurry containing 50% by weight or more of the olefin sulfonates.

The aqueous high concentration slurry of olefin sulfonates according to the present invention may further contain any optional ingredients such as other surfactants solvents, and conventional detergent additives as long as the desired properties are not adversely affected.

According to the present invention, an aqueous high concentration of the olefin sulfonates having the desired low viscosity can be obtained by adding both the component (B) (i.e., sodium chloride and/or potassium chloride) and the component (C) (i.e., the above-mentioned nonionic substances) to the aqueous slurry containing a high concentration of the olefin sulfonates in the specified amounts. Since the resultant high concentration slurry has a lower viscosity at room temperature, the slurry can be efficiently stored and the necessary costs for packaging, transporting, and storing the slurry can be decreased. Furthermore, since sodium chloride, potassium chloride, and the above-specified nonionic substances used as viscosity decreasing agents are neutral, and are effectively used in a relatively small addition amount, the characteristics of the olefin sulfonates as a surfactant are not impaired and the resultant aqueous high concentration slurry can be used as a conventional surfactant in various fields, as for the conventional olefin sulfonates. For example, the present aqueous high concentration slurry of olefin sulfonates can be used as raw materials for various type home detergents such as liquid cloth detergents, dish detergents, and shampoos, as well as granular detergents and industrial detergents.

EXAMPLES

The present invention will now be further illustrated by, but is by no means limited to, the following examples, in which all percentages are expressed on a weight basis unless otherwise specified.

EXAMPLE 1 AND COMPARATIVE EXAMPLE 1

A mixture of $C_{14}$ olefin containing 14.7% of vinylidene type olefin and 85.3% of linear α-olefin were sulfonated using a laboratory-scale thin-film type sulfonation reactor at a mole ratio of $SO_3$/the starting olefins of 1.03. After the sulfonation, the sulfonated product was neutralized with a 8.3% aqueous sodium hydroxide solution in such a way that the free alkaline content of the saponified product was 0.2%. The resultant crude neutralized product was charged to an autoclave and was heated at a temperature of 160° C. for 30 minutes while stirring. Thus, the solution was hydrolyzed. Thereafter, the excess alkali in the resultant mixture was neutralized to form a 38% aqueous solution of the olefin sulfonates.

The aqueous solution obtained above was charged to a kneader or mixer and was dried while stirring with hot air supplied. Thus, a concentrate having a solid content of 90% was obtained. The concentrate was then dried under the conditions of 1 mmHg or less and 70° C. for about 8 hours in a vacuum dryer, followed by grinding in a ball mill. Thus, finely divided powder having an effective or active ingredient content of 95.4%, an unreacted oil content of 1.7%, a sodium sulfate content of 2.2%, and a water content of 0.7% was obtained. Various high concentration slurries having the following composition were obtained from the finely divided powder by adding the predetermined amounts of sodium chloride, the nonionic substances, and pure water. The mixture was wetted at a temperature of 40° C. for 3 hours and was agitated with turbine blades.

| Ingredient | % |
|---|---|
| Olefin sulfonate | 60 |
| Sodium chloride | 3.0 |
| Nonionic substance | 1.0 |
| Water | Balance |

The slurry prepared above was sealed in a test tube and centrifugally defoamed at 8000 rpm for 5 minutes. The slurry was then thoroughly stirred to make it entirely uniform. The viscosity of the slurry was determined at a temperature of 25° C. by using a Brookfield type viscometer at a rotor revolution number of 12 rpm. After rotating for 3 minutes, the viscosity was measured. The results are shown in Table 1.

It should be noted that the polyoxyethylene lauryl alcohol ether used in Run Nos. 11 and 12 is the ether of a primary alcohol.

TABLE 1

| Run No. | Nonionic Substance | Ave. M.W. | $EO_p^-$ or $PO_p^-$ | Viscosity (poise, 25° C.) |
|---|---|---|---|---|
| 1 | Polyoxypropylene glycol | 170 | 2.6 | 145 |
| 2 | Polyoxypropylene glycol | 200 | 3.1 | 133 |
| 3 | Polyoxypropylene glycol | 300 | 4.9 | 148 |
| 4 | Polyoxyethylene sec-alcohol ether ($C_{12}$–$C_{14}$ alkyl) | 510 | 7.0 | 150 |
| 5 | Polyoxyethylene sec-alcohol ether ($C_{12}$–$C_{14}$ alkyl) | 600 | 9.0 | 130 |
| 6 | Polyoxyethylene sec-alcohol ether ($C_{12}$–$C_{14}$ alkyl) | 730 | 12.0 | 147 |
| 7* | Polyoxypropylene glycol | 134 | 2.0 | 188 |
| 8* | Polyoxypropylene glycol | 400 | 6.6 | 195 |
| 9* | Polyoxyethylene sec-alcohol ether ($C_{12}$–$C_{14}$) alkyl) | 420 | 5.0 | more than 500 |
| 10* | Polyoxyethylene sec-alcohol ether ($C_{12}$–$C_{14}$) alkyl) | 860 | 15.0 | 360 |
| 11* | Polyoxyethylene lauryl ether | 583 | 9.0 | more than 500 |
| 12* | Polyoxyethylene lauryl ether | 715 | 12.0 | more than 500 |
| 13* | Polyoxyethylene glycol | 106 | 2.0 | 188 |
| 14* | Polyoxyethylene glycol | 200 | 4.1 | 173 |
| 15* | Polyoxyethylene glycol | 600 | 13.2 | more than 500 |
| 16* | Polyoxyethylene glycol | 1000 | 22.3 | more than 500 |

*: Comparative Example

COMPARATIVE EXAMPLE 2

Olefin sulfonates were prepared in the same manner as in Example 1, except that a mixture of 4.3% of vinylidene type $C_{14}$ olefins and 95.7% of linear $C_{14}$ olefin was used in lieu of the $C_{14}$ olefin mixture in Example 1. From the olefin sulfonates, an aqueous high concentration slurry was prepared in the same manner as in Example 1.

The viscosities determined in the same manner as in Example 1 are as shown in Table 2. As is clear from the results shown in Table 2, the desired decrease in the viscosity at room temperature cannot be obtained when the content of the vinylidene type olefin sulfonates is less than 8% of the total amount of the olefin sulfonates.

TABLE 2

| Run No. | Nonionic Substance | Ave. M.W. | $EO_p^-$ or $PO_p^-$ | Viscosity (poise, 25° C.) |
|---|---|---|---|---|
| 17* | Polyoxypropylene glycol | 200 | 3.1 | more than 500 |
| 18* | Polyoxyethylene sec-alcohol ether ($C_{12}$–$C_{14}$ alkyl) | 600 | 9.0 | more than 500 |
| 19* | Polyoxyethylene, polyoxypropylene sec-alcohol ether ($C_{12}$–$C_{14}$ alkyl) | 623 | $EO_p^- = 5.0$ $PO_p^- = 3.5$ | more than 500 |

*: Comparative Example

EXAMPLE 2

Various high concentration slurries having the compositions listed in Table 3 were prepared from the finely divided powder of the olefin sulfonates obtained in Example 1 in the same manner as in Example 1. The viscosities of the slurries were determined in the same manner as in Example 1.

The results are as shown in Table 3.

TABLE 3

| Run No. | 20 | 21 | 22 | 23 | 24 | 25 | 26 |
|---|---|---|---|---|---|---|---|
| Composition (%) | | | | | | | |
| Olefin sulfonate | 65 | 65 | 60 | 67 | 65 | 60 | 55 |
| Sodium chloride | 2 | 2 | 2.5 | 1.5 | 2 | — | 5 |
| Potassium chloride | — | — | — | — | — | 3 | — |
| Polyoxyethylene sec.-alcohol ether* | 1 | 2 | 5 | 2.0 | 1.5 | 1.5 | 1.5 |
| Water | ←Balance → | | | | | | |
| Viscosity (poise, 25° C.) | 125 | 148 | 130 | 150 | 134 | 130 | 70 |

*: $C_{12}$–$C_{14}$ alkyl, $EO_p^- = 9.0$

EXAMPLE 3

The olefin sulfonic acids prepared in Example 1 were roughly neutralized with an aqueous solution of sodium hydroxide, sodium chloride, and polyoxypropylene, polyoxyethylene sec.-alcohol ether ($C_{12}$–$C_{14}$ alkyl, $EO_p$-=5.0, and $PO_p$-=3.5) and were then charged into an autoclave. After substituting the system with nitrogen, the mixture was heated at a temperature of 160° C. for 30 minutes to obtain an aqueous high concentration slurry of the olefin sulfonate having the following composition.

| Ingredient | % |
|---|---|
| Olefin sulfonates | 65 |
| Sodium chloride | 2.0 |
| Polyoxyethylene, polyoxypropylene sec.-alcohol ether ($C_{12}$–$C_{14}$ alkyl, $EO_{\bar{p}} = 5.0$, $PO_{\bar{p}} = 3.5$ | 1.5 |
| Water | balance |

The resultant slurry was centrifugally defoamed. The viscosity determined in the same manner as in Example 1 was 135 poise at 25° C.

EXAMPLE 4

Olefin sulfonates comprising 50.5% of vinylidene type $C_{14}$ olefin sulfonates and 49.5% of $C_{14}$ α-olefin sulfonates were prepared, in the same manner as in Example 1.

From the resultant olefin sulfonates, a defoamed aqueous slurry containing 65% of the oelfin sulfonates was prepared in the same manner as in Example 3. The contents of the other ingredients were also the same as in Example 3.

The resultant slurry exhibited excellent fluidity at a temperature of 25° C.

We claim:

1. An aqueous high concentration surfactant slurry having a viscosity of 150 poise or less at room temperature comprising:

(A) 50% to 75% by weight of $C_{12}$–$C_{20}$ olefin sulfonates substantially composed of 8 to 60 parts by weight of at least one vinylidene olefin sulfonate and 92 to 40 parts by weight of at least one linear olefin sulfonate;

(B) 1% to 5% by weight of sodium chloride, potassium chloride, or a mixture thereof;

(C) 0.3% to 5% by weight of at least one nonionic substance selected from the group consisting of (C-1) polyoxypropylene glycols having an average molecular weight of 170 to 300, (C-2) ethylene oxide addition products of secondary higher alcohols having a $C_7$–$C_{18}$ alkyl group and an average addition mole number of ethylene oxide of 7 to 12, and (C-3) addition products of ethylene oxide having, an average addition mole number of 3 to 10and propylene oxide having an average addition mole number of 1 to 9 of secondary higher alcohols having a $C_7$–$C_{18}$ alkyl group provided that the total addition mole number of the ethylene oxide and the propylene oxide is 6 to 12.

2. A method for preparing an aqueous high concentration surfactant slurry of claim 1, wherein (i) 1% to 5% by weight of sodium chloride, potassium chloride, or a mixture thereof and (ii) 0.3% to 5% by weight of at least one nonionic substance selected from the group consisting of (C-1) polyoxypropylene glycols having an average molecular weight of 170 to 300, (C-2) ethylene oxide addition products of secondary higher alcohols having a $C_7$–$C_{18}$ alkyl group and an average addition mole number of ethylene oxide of 7 to 12, and (C-3) addition products of ethylene oxide having an average addition mole number of 3 to 10and propylene oxide having, an average addition mole number of 1 to 9 of secondary higher alcohols having a $C_7$–$C_{18}$ alkyl group provided that the total addition mole number of said ethylene oxide and said propylene oxide is 6 to 12 is incorporated into the slurry.

* * * * *